US005864908A

United States Patent [19]

Kielman

[11] Patent Number: 5,864,908

[45] Date of Patent: Feb. 2, 1999

[54] ROLLABLE PORTABLE MAT SYSTEM WITH COVER

[76] Inventor: Todd Kielman, 509 N. Noble, #2R, Chicago, Ill. 60622

[21] Appl. No.: 55,168

[22] Filed: Apr. 4, 1998

[51] Int. Cl.[6] ..... A47C 27/14; A47G 9/06

[52] U.S. Cl. ..... 5/738; 5/420; 5/922

[58] Field of Search ..... 5/417–420, 737, 5/738, 922, 923, 485, 490

[56] References Cited

U.S. PATENT DOCUMENTS

| | | | |
|---|---|---|---|
| 1,867,425 | 7/1932 | Swetzel | 5/485 |
| 3,958,274 | 5/1976 | Klauber | 5/420 |
| 4,231,125 | 11/1980 | Tittl | 5/419 |
| 5,203,041 | 4/1993 | Alonso | 5/420 |
| 5,287,571 | 2/1994 | Rademacher | 5/922 |
| 5,297,304 | 3/1994 | O'Sullivan | 5/922 |
| 5,491,851 | 2/1996 | Alonso | 5/420 |

FOREIGN PATENT DOCUMENTS

| | | | |
|---|---|---|---|
| 564949 | 7/1957 | Italy | 5/485 |
| 821966 | 10/1959 | United Kingdom | 5/485 |
| 927094 | 5/1963 | United Kingdom | 5/485 |

*Primary Examiner*—Alex Grosz
*Attorney, Agent, or Firm*—Michael S. Neustel

[57] ABSTRACT

A portable mat system for receiving and retaining a mattress thereby reducing movement of the mattress and thereby protecting the mattress. The inventive device includes a first sheet, a second sheet having three sides attached to the first sheet forming a pocket with an open end, a lip attached to the second sheet adjacent the open end, a flap attached to the first sheet, a length of Velcro attached to the flap and a back side of the first sheet, an aperture is within the second sheet for receiving an air valve of an air mattress, and a handle attached to the back side of the first sheet. The lip is sewn to the inside portion of the second sheet for retaining the mattress within the pocket. When the user is finished using the present invention, the user simply rolls the invention, with or without the mattress within, into a cylindrical shape and then engages the Velcro. The user then may transport the invention in the storage position by grasping the handle. In an alternative embodiment, Velcro is utilized to attach a plurality of the first sheets together thereby allowing more than one mattress to be utilized in a common area.

15 Claims, 4 Drawing Sheets

ROLLABLE PORTABLE MAT SYSTEM WITH COVER

BACKGROUND OF THE INVENTION

1. Field of the Invention

The present invention relates generally to mat devices and more specifically it relates to a portable mat system for receiving and retaining a mattress commonly utilized within tents thereby reducing movement of the mattress. The present invention also protects the mattress from being soiled or damaged during use.

Inflatable mattresses are commonly used by individuals who camp or travel cross-country on bicycle. A common problem with inflatable mattresses, or other similar mattresses, is that they are easily moved about within a tent structure. Another problem with inflatable mattresses is that they can become easily soiled or damaged from direct contact with the ground. Another problem with using inflatable mattresses is the nylon covering upon them can be extremely uncomfortable for an individual to sleep directly upon.

2. Description of the Prior Art

There are numerous mat devices. For example, U.S. Design Pat. No. 303,466 to Haggerty et al; U.S. Pat. No. 3,846,856 to Tu; U.S. Pat. No. 4,738,545 to Westgor; U.S. Pat. No. 5,117,519 to Thomas; U.S. Pat. No. 5,203,041 to Alonso; U.S. Pat. No. 5,010,610 to Ackley; U.S. Pat. No. 4,329,747 to Russell; U.S. Pat. No. 5,287,571 to Rademacher; U.S. Pat. No. 4,757,832 to Russell all are illustrative of such prior art.

Westgor (U.S. Pat. No. 4,738,545) discloses a combined mat and carrying bag unit which includes a sheet of pliable material defining a mat. The sheet has a drawstring casing extending about its periphery which contains a drawstring which contracts the size of the periphery when pulled from the casing. However, Westgor does not teach a structure which allows the selective insertion or removal of a swaged mattress.

While these devices may be suitable for the particular purpose to which they address, they are not as suitable for receiving and retaining a thin mattress commonly utilized within tents thereby reducing movement of the mattress. The prior art merely teaches the use of simple mats without the capabilities of selectively receiving various types of mattresses as taught in the present invention.

In these respects, the portable mat system according to the present invention substantially departs from the conventional concepts and designs of the prior art, and in so doing provides an apparatus primarily developed for the purpose of receiving and retaining a thin mattress commonly utilized within tents thereby reducing movement of the mattress.

SUMMARY OF THE INVENTION

A primary object of the present invention is to provide a portable mat system that will overcome the shortcomings of the prior art devices.

Another object is to provide a portable mat system that receives and retains a swaged mattress.

An additional object is to provide a portable mat system that reduces the amount of movement of a mattress within a tent.

A further object is to provide a portable mat system that protects the mattress from being soiled or damaged.

Another object is to provide a portable mat system that increases the comfort to the user since they do not have direct contact with the uncomfortable mattress.

Another object is to provide a portable mat system that can be set up without having to erecting a conventional tent.

An additional object is to provide a portable mat system which does not require the common "stuff sack" for storing the mattress during non-use.

A further object is to provide a portable mat system which does not require the mattress to be removed for inflating or deflating.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DESCRIPTION OF THE PREFERRED EMBODIMENT

Figure 1:
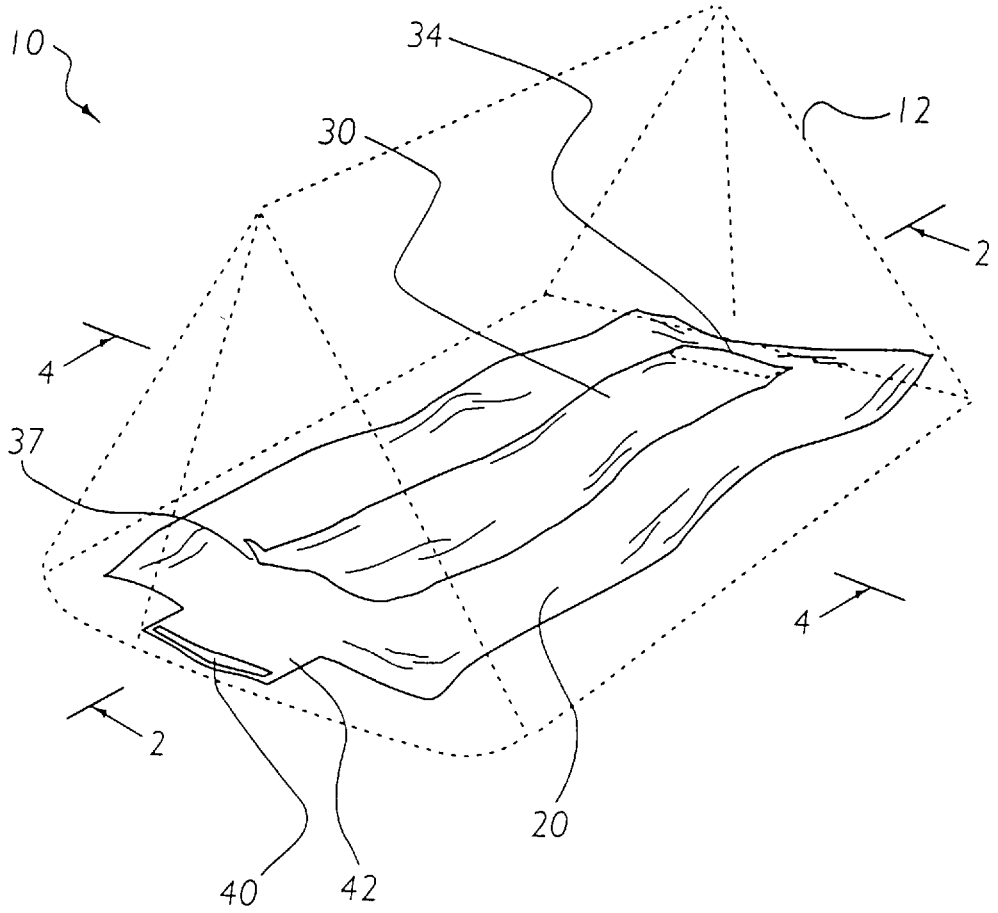
FIG. 1 is an upper perspective view of the present invention within a conventional tent.

Turning now descriptively to the drawings, in which similar reference characters denote similar elements throughout the several view, FIGS. 1 through 5 illustrate a portable mat system 10, which comprises a first sheet 20, a second sheet 30 having three sides attached to the first sheet 20 forming a pocket 32 with an opening 36, a lip 34 attached to the inside portion of the second sheet 30 adjacent the opening 36, a flap 42 attached to the first sheet 20, a length of Velcro 40 attached to the flap 42 and a lower surface of the first sheet 20, and a handle 50 attached to the lower surface of the first sheet 20. When the user is finished using the present invention, the user simply rolls the invention, with or without the mattress within, into a cylindrical shape and then engages the Velcro 40. The user then may transport the invention in the storage position by grasping the handle 50. In an alternative embodiment, Velcro 70 is utilized to attach a plurality of the first sheets 20 together thereby allowing more than one mattress to be utilized in a common area.

Figure 2:
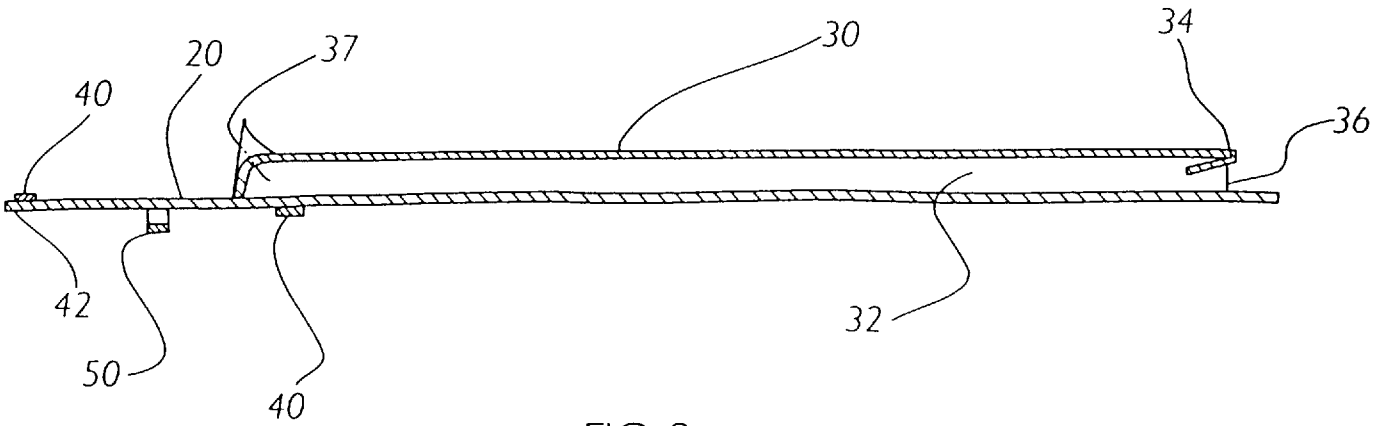
FIG. 2 is a cross sectional view taken along line 2—2 disclosing the pocket which receives a mattress.
Figure 3:
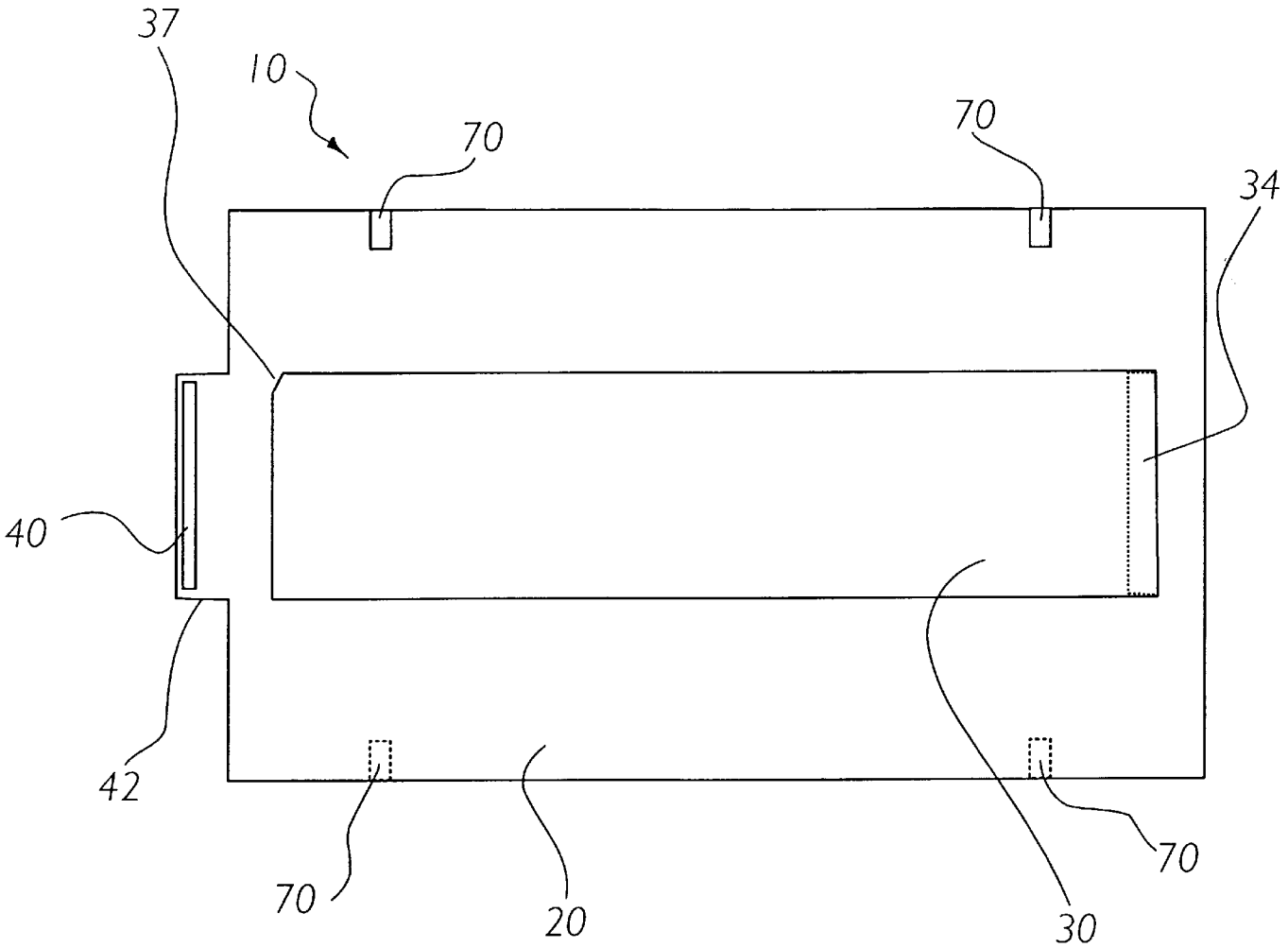
FIG. 3 is a top view of the present invention.
Figure 4:
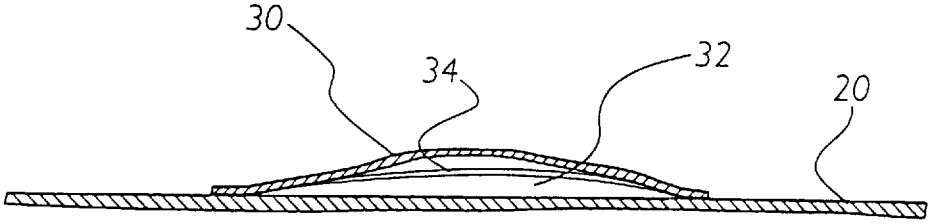
FIG. 4 is a cross sectional view taken along line 4—4 of FIG. 1.

As shown in FIG. 1 of the drawings, the first sheet 20 covers approximately the same area as the floor of a conventional tent 12. The first sheet 20 is preferably constructed from a pliable and durable material such as nylon. As best shown in FIGS. 2 through 4 of the drawings, the second sheet 30 is attached to an upper surface of the first sheet 20. The second sheet 30 is preferably constructed from a pliable and comfortable material such as cotton for providing a comfortable surface for the user to lay upon. The pair of longitudinal sides and an end of the second sheet 30 are attached to the first sheet 20 as best shown in FIGS. 2 and 4 of the drawings.

A pocket 32 is formed between the first sheet 20 and the second sheet 30 which snugly receives a mattress as best shown in FIG. 2 of the drawings. An opening 36 exposes the pocket 32 and receives the mattress as best shown in FIG. 2 of the drawings. As best shown in FIG. 3 of the drawings, an aperture 37 projects into a corner of the second sheet 30 adjacent the closed end of the pocket 32. The aperture 37 receives an air valve from an air mattress for allowing inflation or deflation of the air mattress without having to remove the air mattress from the pocket 32.

As shown in FIGS. 1 through 3 of the drawings, the lip 34 is attached to the ceiling portion of the pocket 32 comprising the second sheet 30 adjacent the opening 36. The lip 34 prevents the mattress from being accidentally removed from the pocket 32 by engaging the end of the mattress similar to a pillow cover.

Figure 5:
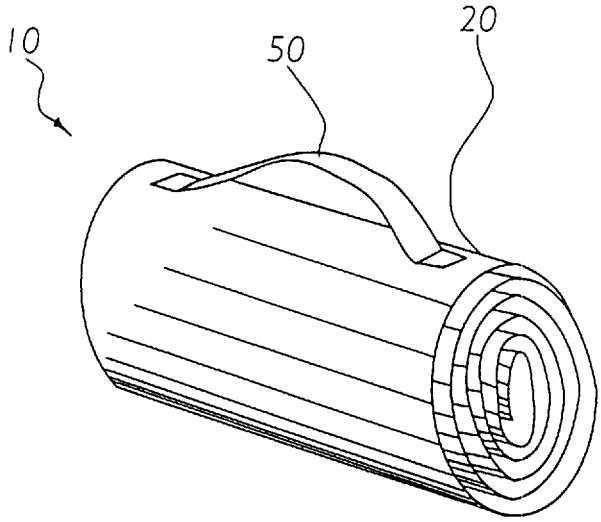
FIG. 5 is an upper perspective view of the present invention in the storage position.

As shown in FIGS. 2 and 3 of the drawings, a flap 42 is attached to the end of the first sheet 20. The flap 42 has an upper surface and a lower surface corresponding to the first sheet 20. A first length of Velcro 40, or other fastening device, is attached to the upper surface of the flap 42 as best shown in FIGS. 2 and 3 of the drawings. A second length of Velcro 40 is attached to the lower surface of the first sheet 20 near the first length of Velcro 40 as shown in FIG. 2 of the drawings. A handle 50 is attached between the end of the flap 42 and the second length of Velcro 40 as shown in FIG. 2 of the drawings. When the user is finished using the present invention, the end opposite of the flap 42 is rolled toward the flap 42. The first length of Velcro 40 is manipulated into engagement with the second length of Velcro 40 to retain the invention in a storage position as shown in FIG. 5 of the drawings. The user may then grasp the handle 50 to transport the invention.

In use, the user spreads the present invention into an area where they want to lay upon. The user then inserts an air mattress, or similar mattress, into the pocket 32 of the present invention. The user then inflates the air mattress with the desired air pressure by manipulating an air valve of the air mattress through the aperture 37. During use, the mattress is retained in the same position with respect to the tent 12 regardless of the amount of traffic over or around it. Further, the lip 34 prevents the air mattress from accidentally becoming dislodged from the pocket 32. When the user is finished utilizing the present invention, the user then releases the air pressure from the air mattress through the aperture 37. The user then rolls the end of the first sheet 20 opposite of the flap 42 towards the flap 42 end. After the present invention along with the mattress is rolled into a compact storage position, the first length of Velcro 40 is manipulated into engagement with the second length of Velcro 40 to retain the present invention in the compact storage position. The user then grasps the handle 50 which is exposed for transporting the present invention.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A portable mat system, comprising a first sheet having an upper surface and a lower surface;

a second sheet attached to said upper surface of said first sheet;

a pocket between said first sheet and said second sheet having an opening, wherein said pocket is capable of receiving a mattress;

wherein said second sheet has a smaller area than said first sheet;

wherein said second sheet includes a lip adjacent said opening for retaining said mattress within said pocket;

a flap attached to an end of said first sheet;

a first length of hook and loop fastener attached to an upper surface of said flap; and a second length of hook and loop fastener attached to said lower surface of said first sheet near said flap, wherein said first length of hook and loop fastener is engageable within said second length of hook and loop fastener for retaining a compact storage position.

2. The portable mat system of claim 1, including a handle attached to said lower surface of said first sheet.

3. The portable mat system of claim 2, wherein said handle is positioned between said second length of hook and loop fastener and said flap.

4. The portable mat system of claim 3, wherein said second sheet is constructed of a pliable and comfortable material to sleep upon.

5. The portable mat system of claim 4, wherein said second sheet is constructed of cotton.

6. The portable mat system of claim 5, wherein said second sheet includes an aperture for receiving an air valve stem from said mattress.

7. The portable mat system of claim 6, wherein said first sheet is constructed of nylon.

8. The portable mat system of claim 7, wherein said first sheet and said second sheet are rectangular shaped.

9. The portable mat system of claim 8, wherein said handle is constructed of a resilient material.

10. A portable mat system comprising:

a first sheet having an upper surface and a lower surface;

a second sheet attached to said upper surface of said first sheet;

a pocket between said first sheet and said second sheet having an opening, wherein said pocket is capable of receiving a mattress;

a third length of hook and loop fastener secured to a side of said first sheet for allowing attachment of said first sheet to another first sheet;

wherein said second sheet includes a lip adjacent said opening for retaining said mattress within said pocket;

a flap attached to an end of said first sheet;

a first length of hook and loop fastener attached to an upper surface of said flap; and a second length of hook and loop fastener attached to said lower surface of said first sheet near said flap, wherein said first length of hook and loop fastener is engageable within said second length of hook and loop fastener for retaining a compact storage position.

11. The portable mat system of claim 10, including a handle attached to said lower surface of said first sheet.

12. The portable mat system of claim 11, wherein said handle is positioned between said second length of hook and loop fastener and said flap.

13. The portable mat system of claim 12, wherein said second sheet is constructed of cotton.

14. A portable mat system, comprising:

a first sheet having an upper surface and a lower surface;

a second sheet attached to said upper surface of said first sheet;

a pocket between said first sheet and said second sheet having an opening, wherein said pocket is capable of receiving a mattress;

wherein said second sheet has a smaller area than said first sheet;

a flap attached to an end of said first sheet;

a first length of hook and loop fastener attached to an upper surface of said flap; and a second length of hook and loop fastener attached to said lower surface of said first sheet near said flap, wherein said first length of hook and loop fastener is engageable within said second length of hook and loop fastener for retaining a compact storage position.

15. The portable mat system of claim 14, wherein said second sheet includes a lip adjacent said opening for retaining said mattress within said pocket.

* * * * *